United States Patent [19]

Langer

[11] Patent Number: 4,794,986

[45] Date of Patent: Jan. 3, 1989

[54] RETICULATED CENTRALIZING APPARATUS

[75] Inventor: Friedrich H. Langer, Houston, Tex.

[73] Assignee: Weatherford U.S., Inc., Houston, Tex.

[21] Appl. No.: 126,193

[22] Filed: Nov. 27, 1987

[51] Int. Cl.[4] ..... E21B 17/10

[52] U.S. Cl. ..... 166/241; 175/325

[58] Field of Search ..... 166/241, 170, 172, 173, 166/175, 166, 138, 213, 216; 175/325

[56] References Cited

U.S. PATENT DOCUMENTS

| | | | |
|---|---|---|---|
| 2,482,985 | 9/1949 | Lockwood | 166/173 |
| 2,515,149 | 7/1950 | Willhoit | 166/241 |
| 2,665,762 | 1/1954 | Althouse, Jr. | 166/241 |
| 3,124,196 | 3/1964 | Solum | 166/241 |
| 3,566,965 | 3/1971 | Solum | 166/241 |
| 3,575,239 | 4/1971 | Solum | 166/241 |
| 4,143,713 | 3/1979 | Kreft | 166/241 |
| 4,520,869 | 6/1985 | Svenson | 166/241 |
| 4,531,582 | 7/1985 | Muse et al. | 166/241 |
| 4,651,823 | 3/1987 | Spikes | 166/241 |
| 4,681,161 | 7/1987 | Arterbury et al. | 166/241 X |

FOREIGN PATENT DOCUMENTS

| | | |
|---|---|---|
| 259484 | 1/1968 | Austria . |
| P3508086.8-24 | 3/1985 | Fed. Rep. of Germany . |
| 1184919 | 10/1985 | U.S.S.R. . |
| 1014736 | 12/1965 | United Kingdom . |
| 1110840 | 4/1968 | United Kingdom . |

OTHER PUBLICATIONS 1986-87 Products and Services Catalog, Weatherford International, Inc., Houston, Tex., pp. 1-78.

Product Information Cementing Aids GmbH, (Catalog), 02-1985, Weatherford International, Inc., Houston, Tex.

API Specification for Casing Centralizers, Feb. 17, 1986, American Petroleum Institute, Dallas, Tex., pp. 1-14.

Control Formation Sand, 09-1982, Howard Smith Screen Company, Houston, Tex., pp. 1-29.

Primary Cementing Equipment for Better Well Completions, Gemoco, Houma, La., 70361, pp. 1-19.

Well Completion Service & Equipment Catalog, B & W Incorporated 1974-1975 Catalog.

*Primary Examiner*—Stephen J. Novosad

*Attorney, Agent, or Firm*—Vaden, Eickenroht, Thompson & Boulware

[57] ABSTRACT

A reticulated centralizing apparatus and methods for its use. The apparatus has a plurality of pairs of collars or cages and a plurality of springs or bows connected to and extending between the collars or cages. The bows of one pair of collars pass over one collar of another pair of collars. The bows can be alternated singly or in groups and one pair of collars may have a certain number of bows different from the number of bows associated with another pair of collars.

11 Claims, 9 Drawing Sheets

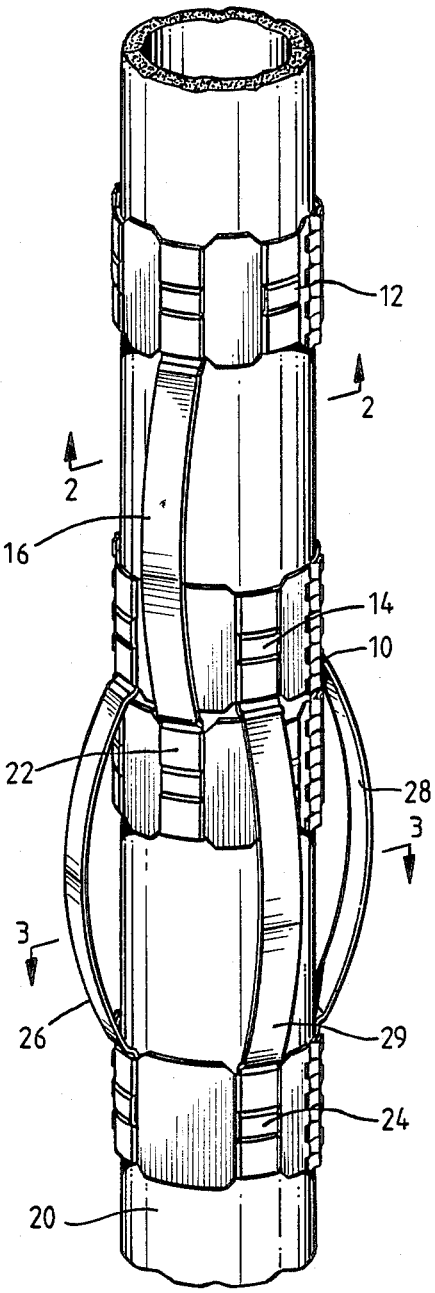
Fig.1
Fig.2
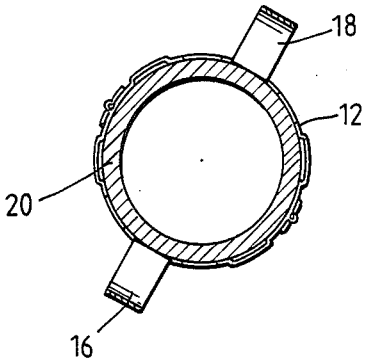
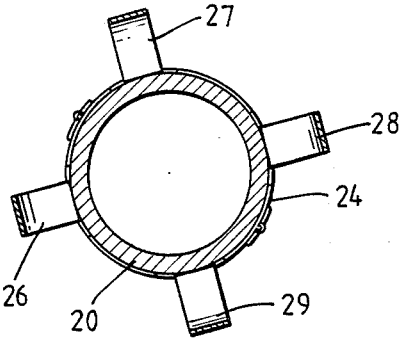
Fig.3

Fig. 4
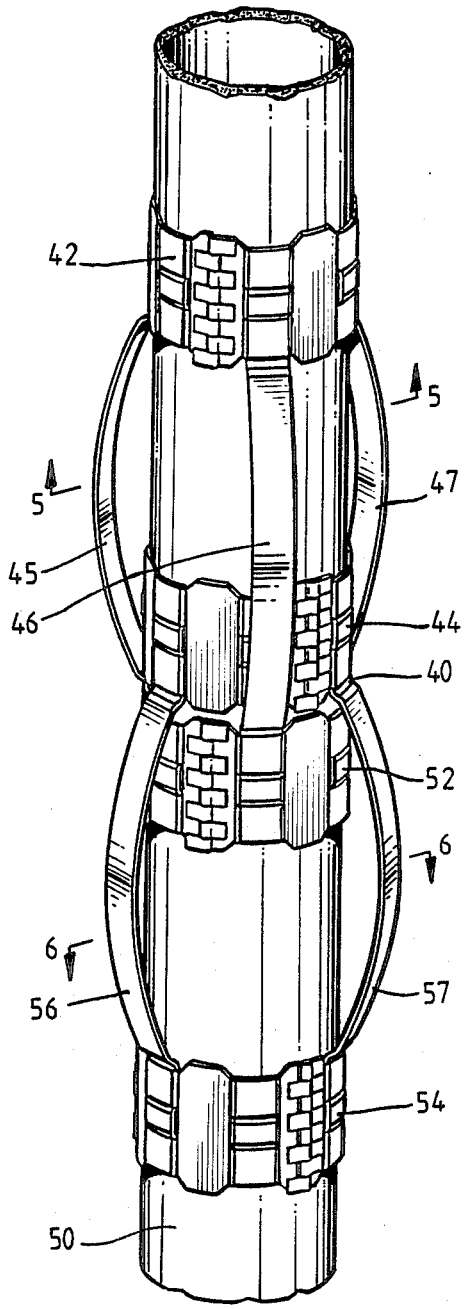
Fig. 5
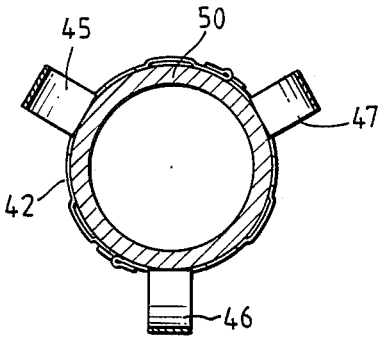
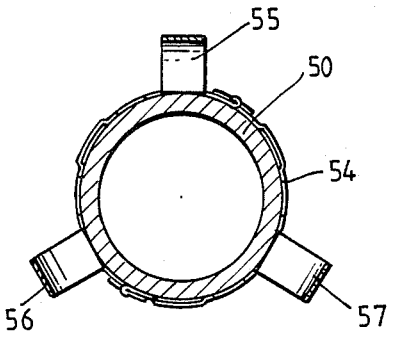
Fig. 6

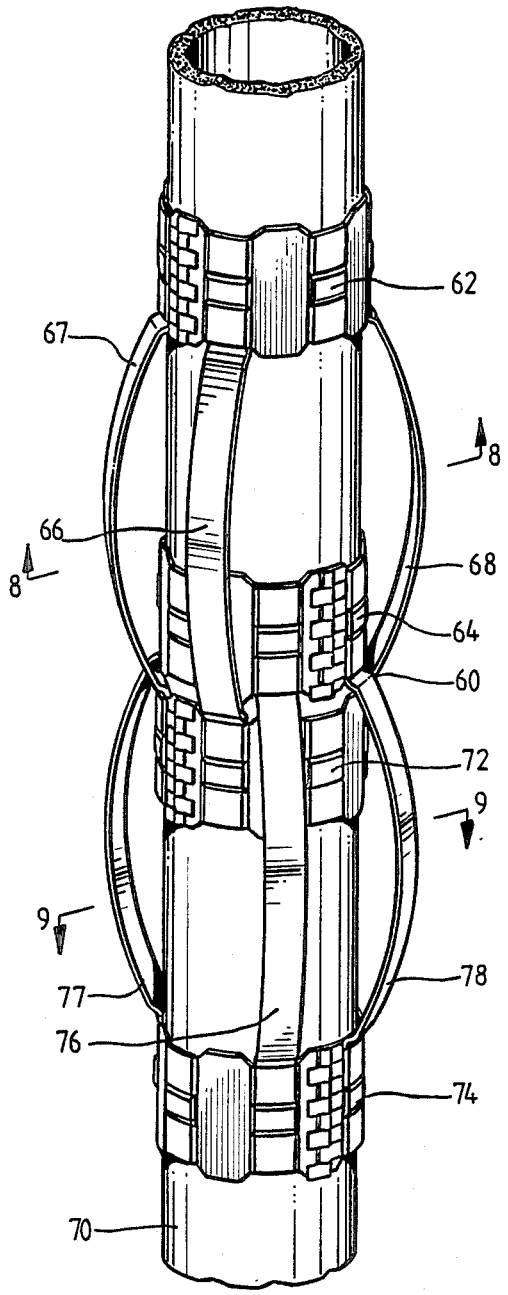
Fig. 7
Fig. 8
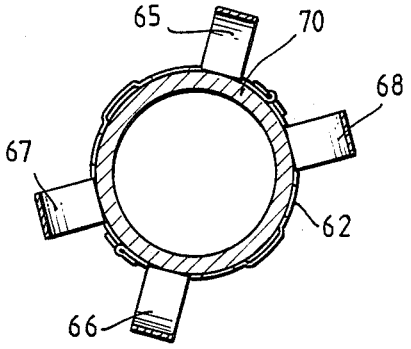
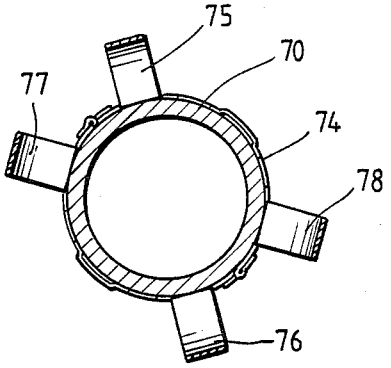
Fig. 9

RETICULATED CENTRALIZING APPARATUS

BACKGROUND OF THE INVENTION

1. Field of the Invention

This invention relates to centralizing devices for maintaining a well conduit such as casing in a central position in a wellbore and to methods for their use, and particularly to reticulated centralizing apparatuses.

2. Description of the Prior Art

Centralizers have long been used in the oil industry for centering well pipe or casing in a wellbore, particularly in casing cementing operations. Common conventional centralizers have collars which are connected by and spaced apart by outwardly directed staves, springs or bows which abut and press against the wall of the wellbore.

Several disadvantages are associated with the use of prior art centralizers. Initially inserting a centralizer mounted on a casing string into a wellbore, the springs or bows are compressed inwardly, since the opening into which the casing is inserted usually is not very much greater in diameter than the casing string itself. The bowed portions, therefore, are subjected to comparatively large forces in compressing them through a great portion of their deflection toward the casing string, requiring a corresponding large force or load to be imposed downwardly upon the casing string.

In many instances, with multiple springs, the centralizer cannot be started in the opening merely by the weight of the casing itself on which the centralizer is mounted. Often external weight or forces have to be applied on the casing string. The comparatively great force being exerted by the springs on the upper edge of the opening into which they are inserted creates correspondingly great forces between the springs and the surface casing, which must be overcome in lowering the casing string on which the centralizer is mounted, and which may create wear on the springs. Often, the centering force requirement dictates the use of a large number of bows disposed between two collars. A substantial resistance to insertion is encountered due to, inter alia, the force between the bows and the tubular or bore into which the centralizer is to be inserted.

Often a spider is used with casing. Spiders frequently have guide plates mounted on them to protect the spider's slips from damage by the casing. These guide plates have a circular opening which can be slightly smaller than a borehole; e.g. a borehole may be 12.25 inches wide, but the guide plate opening may be only 10.88 inches wide. Nevertheless, a casing joint with a centralizer installed on it must be insertable through the guide plate opening—requiring even greater starting forces.

Although there are a variety of prior art centralizers with multiple collars and multiple bows, none employs multiple pairs of standard collars and a plurality of standard bows. Also, the prior art apparatuses that do have multiple collars are more difficult to handle, to transport, and to work with than apparatuses according to this invention.

The American Petroleum Institute's Specification 10D provides minimum performance standards, test procedures and marking requirements for casing centralizers. It defines various parameters relating to centralizers as follows:

a. Starting Force: Starting force is the maximum force required to start a centralizer into the previously run casing. The maximum starting force for any centralizer shall be less than the weight of 40 feet (12.2 m) of medium weight casing (see Table 2.1). The maximum starting force is to be determined for a centralizer in new, fully assembled, condition as delivered to the end user, i.e. before the bow springs are subjected to "permanent set." The maximum allowable starting force shall apply to the smallest hole size a centralizer is specified for.

b. Permanent Set: Permanent set is the attainment by the centralizer of a constant bow height less than the original bow height of the bow-springs after repeated flexing of the bow springs. A permanent set is considered established if the bow height remains constant after each spring has been flattened twelve times. The requirement to establish a permanent set of the bow springs before restoring force data are measured simulates the running of the centralizer through bore hole sections.

c. Running Force: Running force is the maximum force required to move a centralizer through the previously run casing. The running force is proportional to and always equal to or less than the starting force. It is a practical value which gives the maximum "running drag" produced by a centralizer in the smallest hole size specified.

Note: Starting and running force values are based on installation of the centralizer per manufacturer's recommendations. Both forces can increase substantially through "wrong" installation (i.e. a close tolerance centralizer which is, contrary to its design, installed over a casing collar).

d. Flattened: Flattened is defined as the point where the springs will not continue to deflect when three times the minimum restoring force is applied to the outer pipe during the starting force and running force tests.

e. Annular Clearance: Annular clearance is the distance between the outside of the casing and the borehole wall when the casing is perfectly centralized.

f. Standoff: For cases where the casing is not centralized, standoff is the smallest distance between the outside of the casing and the borehole wall.

g. Standoff Ratio: The standoff ratio is the ratio of standoff to annular clearance, expressed as a percentage. For example:

For a 7 inch (178 mm) centralizer run in a 8½ inch (216 mm) hole, which is intended to maintain a standoff of 0.5 inches (12.7 mm) the standoff ratio is calculated as follows:

$$\text{Annular clearance} = \frac{8.5 - 7}{1} = 0.750 \text{ inches}$$

$$\left(\frac{216 - 178}{.2} = 19 \text{ mm}\right)$$

$$\text{Standoff to annular clearance ratio} = \frac{0.5}{0.750} = 0.67$$

$$\left(\frac{12.7}{19} = 0.67\right) \text{or 67 percent}$$

h. Restoring Force: The restoring force is the force exerted by a centralizer against the casing to keep it away from the bore hole wall. The restoring force required from a centralizer, to maintain adequate standoff, is small in a vertical hole, but substantial for the same centralizer in a deviated hole.

Field observations indicate hole deviation on an average varies from zero to approximately 60 degrees: therefore, an average deviation of 30 degrees is used to calculate restoring force requirements, listed in Table 2.1.

For casing sizes 10¾ inches (273 mm) through 20 inches (508 mm), casing strings generally placed in relatively vertical hole sections, the minimum restoring force shall be not less than:

$$RF = W \text{ SIN } 30 = \frac{W}{2}$$

Where:

RF=Minimum restoring force

W=weight of 40 ft. (12.2 m) of medium weight casing

For casing sizes 4½ inches (114 mm) through 9⅝ inches (244 mm), casing strings generally placed in the deviated hole sections, the minimum restoring force shall be not less than:

$$RF = 2 \text{ W SIN } 30 = W$$

The factor of 2 is established as a compensating factor for effect of doglegs.

Due to the applicability of many centralizers in a wide variety of hole sizes, any minimum restoring force specification for centralizer must be based on a standoff value or standoff ratio. A standoff ratio of 0.67 (67 percent standoff) is used in this standard for all minimum restoring force values.

Note: The previously stated ratio of 0.67 is not intended as a specification for adequate centralization of casing in the field, but merely for the purpose of specifying minimum performance standards. Actual restoring force values at various standoff's can be obtained from force-deflection curves as generated from the test procedure contained in Section 4 of this standard.

i. Hole Size Range: The hole size range for which a centralizer meets these specifications and is marked with, in compliance with Section 3, indicates the smallest and largest hole size for which such centralizer meets these specifications. The smallest hole size will be determined by the maximum starting force requirement, the largest by the minimum restoring force requirement.

In accordance with 37 C.F.R. §1.56, submitted herewith are copies of the following which may be material to this application:

U.S. Pat. No. 2,665,762 discloses a centralizer having springs with comparatively large bowed heights which reduces force by providing a coupling collar for connection with the pin ends of casing, the coupling collar providing a stop member for contacting the upper or lower cage of the centralizer so that when a restriction or tight place is encountered the centralizers bows (springs) are urged inwardly to reduce the force.

U.S. Pat. No. 3,124,196 discloses a centralizer with inclined bows having an arcuate cross-section of sufficiently small radius to present a rounded surface engagement with the wellbore wall.

U.S. Pat. No. 3,566,965 discloses a centralizer with conventional bows and collars formed of a plurality of releasably connected segments which permit tiers of bows to be formed.

U.S. Pat. No. 3,575,239 discloses a centralizer wherein the position of some of its bows is longitudinally offset from other bows whereby less than all of the bows are engaged simultaneously when forcing the device into an opening.

U.S. Pat. No. 4,143,713 discloses a centralizer with its bows held by lugs to keep them engaged in their collars.

U.S. Pat. No. 4,520,869 discloses a centralizer having bows with a "hat" section for positioning in a channel in the collar. Compressing the channel into the bow hat section locks the bow in place.

U.S. Pat. No. 4,531,582 discloses a centralizer with bows having a concave configuration at their apexes, but not near their ends. An L-shaped extension of the collars serves as a restoring force increasing point after the bows have been depressed a certain amount.

German Patent Application No. P3508086.8-24 discloses a centralizer with axially offset asymmetrical bows. This German application is assigned to a sister company of the assignee of the present application.

U.K. Patent No. 1,110,840 and Austrian Patent No. 259,484 disclose a centralizer with collars and bows with a number of U-shaped, outwardly-directed extensions which are received into and secured in the collars. U.K. Patent No. 1,110,840 discloses a centralizer with three collars connected by two bundles of leaf springs, four springs extending from each outside collar to a central collar connected to all eight springs. These two patents are assigned to a sister company of the assignee to the present application.

U.K. Patent No. 1,014,736 discloses a centralizer with two outer collars or spring cages and an intermediate non-standard collar or spring cage with springs or bows extending from each outside collar to the intermediate non-standard collar, the springs or bows being staggered in an axial direction so that ends of oppositely directed springs or bows overlap.

API Spec 10D discloses various general information about centralizers.

B&W Incorporated's 1974–1975 catalog (excerpt) discloses centralizer bows with an arched shape.

"Control Formation Sand," Howard Smith Screen Company, 1982, discloses a variety of conventional centralizers. (See p. 19).

"Primary Cementing Equipment," GEMOCO, 1986 discloses a variety of centralizers and bows.

Weatherford, "Product Information Cementing Aids GmbH," 1985 discloses a variety of prior art bows and centralizers. Weatherford Oil Tool GmbH is a sister company to the assignee of the present application.

Weatherford, "1986–87 Products and Services Catalogs," 1985 (primarily pages 22–28) discloses a variety of prior art bows and centralizers. Weatherford International, Inc. is the parent company of the assignee of the present application.

There has long been a need for a centralizer with multiple bows which is accurate and efficient with a low starting force, yet with an acceptably high restoring force, and which is easy to handle and to assemble.

SUMMARY OF THE PRESENT INVENTION

The present invention is directed to new and unobvious reticulated centralizing apparatuses. The new centralizing apparatus has a plurality of collars or spring bow cages (two or more pairs) and a plurality of spring bows interconnected between the collars or cages to form a reticulated centralizing apparatus. The collars or cages and springs or bows are disposed so that the springs or bows extend from a first collar or cage, pass over an intemediate collar or cage, and are connected to a second collar or cage. Standard conventional collars and bows can be used.

The number of bows connected to each pair of collars can be varied. For example a prior art centralizer may have two collars and six bows spaced about and connected between the collars. According to this invention a centralizing device may have six bows with two bows extending between a first pair of collars and four bows extending between the second pair of collars. The bows, for example, may be alternated; e.g. in the six bow example the four bows may be divided into two sets of two bows each disposed with one each of the bows of the first pair of collars extending therebetween. In another embodiment with three bows between each pair of collars the bows may be alternated singly with one bow of the first collar pair adjacent one bow of the second collar pair. Also, e.g., pairs or threesomes of bows may be alternated.

According to the present invention, not all the bows of the centralizing apparatus are disposed in side-by-side relation; rather the bows are longitudinally staggered. One desireable result of this configuration is that a centralizing apparatus with a certain number of bows requires less starting force for insertion into a hole than a prior art one-collar-pair centralizer with an equal number of bows. Another advantage of centralizing apparatuses according to this invention is the increased centralizing forces obtained as compared to prior art centralizers with the same number of bows.

The reticulated centralizing apparatus according to this invention can be assembled and then placed on a tubular such as common casing or it can be assembled on the casing itself. For example, four collars can be disposed in spaced apart relationship. Then bows can be connected between the first and third collars (a first pair of collars) and between the second and fourth collars (a second pair of collars). As desired, bows can be disposed alternately or in groups of more than one bow. Any workable number of pairs of collars and bows or groups of bows can be used. Then the assembled apparatus can be emplaced about casing. In another method, the collars can be emplaced around the casing prior to connecting the bows between the collars. The collars can and may contact each other.

The present invention, therefore, recognizes address, and satisfies the long-felt need for an accurate, efficient multiple-bow centralizer and for a centralizer with a low starting force and an acceptably high restoring force.

It is, therefore, an object of this invention to provide a novel and unobvious reticulated centralizing apparatus.

Another object of this invention is the provision of a reticulated centralizing apparatus which provides the necessary centralizing effect, yet which has a reduced starting force as compared to prior art devices.

Yet another object of this invention is the provision of a reticulated centralizing apparatus employing two or more pairs of collars or spring cages and having a plurality of bows extending between the collars or cages.

A further object of this invention is the provision of such a reticulated centralizing apparatus in which bows or groups of bows are disposed alternately between each of the pairs of collars.

An additional object of this invention is the provision of such a centralizing apparatus in which the bow or bows connected between a first pair of collars pass over one collar of a second pair of collars.

A specific object of this invention is the provision of a centralizing apparatus which uses conventional standard commercially available collars and bows and which does not require custom-made collars.

Another object of the present invention is the provision of methods for centralizing tubulars such as casing using the described reticulated centralizing appartuses.

These and other objects and advantages inherent in this invention will be clear to one of skill in this art who has the benefit of this invention's teachings which include the drawings and the following description of presentlypreferred embodiments of the invention which are given for the purpose of disclosure in accord with the patent laws of the United States.

BRIEF DESCRIPTION OF THE DRAWINGS

FIG. 1 is a side perspective view of one embodiment of a centralizing apparatus according to the present invention showing it emplaced on a casing member.

FIG. 2 is a cross-sectional view along line 2—2 of FIG. 1.

FIG. 3 is a cross-sectional view along line 3—3 of the centralizing apparatus of FIG. 1.

FIG. 4 is a side perspective view of another centralizing apparatus according to the present invention showing it emplaced on a casing member.

FIG. 5 is a cross-sectional view along line 5—5 of the apparatus of FIG. 4.

FIG. 6 is a cross-sectional view along line 6—6 of the apparatus of FIG. 4.

FIG. 7 is a side perspective view of another centralizing apparatus according to the present invention showing it emplaced on a casing member.

FIG. 8 is a cross-sectional view along line 8—8 of the apparatus of FIG. 7.

FIG. 9 is a cross-sectional view along line 9—9 of the apparatus of FIG. 7.

DESCRIPTION OF PREFERRED EMBODIMENTS

Figure 10:
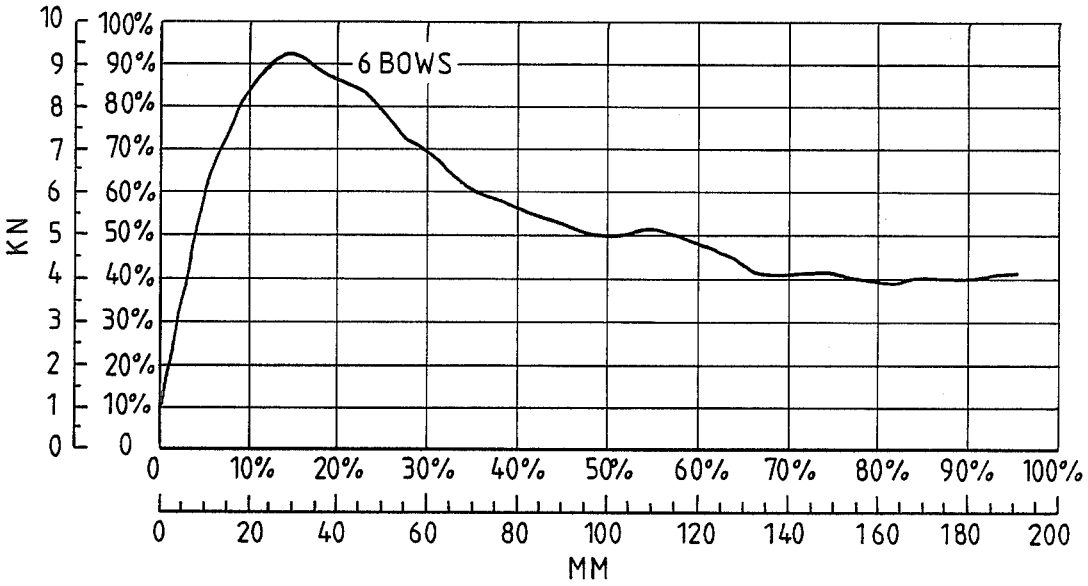
FIG. 10 presents a graph with data related to a prior art centralizer.

As shown in FIGS. 1, 2, and 3 the reticulated centralizing apparatus 10 according to this invention has two pairs of collars 12, 22 and 14, 24 emplaced about a piece of casing 20. Two bows 16 and 18 are connected to and between the first pair of collars 12, 22. Each of the bows 16 and 18 passes over the collar 14 which is emplaced between the collars 12 and 22. Four bows 26, 27, 28 and 29 are connected to and between the pair of collars 14, 24, with each bow passing over the collar 22 which is emplaced between the collars 14 and 24. Depending upon the particular collars used, the collars may be free to rotate about the tubular or to move up and down on it. In use the collar 14 may contact the collar 12 or the collar 22. In use the bows 16, 18 may contact the collar 14 and the bows 26–29 may contact the collar 22. Also a bow such as bow 16 may contact adjacent bows such as either bow 26 or bow 29.

As shown in FIGS. 2 and 3 the bows 16 and 18 are disposed diametrically across from each other and between the two pairs of bows 26, 29 and 27, 28 connected to the collar pair 14, 24. The bows 26, 27, 28, and 29 are spaced equally about the collars 14 and 24.

As shown in FIGS. 4, 5, and 6 the reticulated centralizing apparatus 40 according to the present invention has two pairs of collars 42, 52 and 44, 54 emplaced about a casing member 50. Three bows 45, 46, and 47 are connected to and between the collar pair 42, 52. Each of the bows 45, 46, 47 passes over the collar 44 which is emplaced between the collars 42 and 52. Three bows 55, 56, and 57 are connected to and between the pair of collars 44, 54, with each bow passing over the collar 52 which is emplaced between the collars 44 and 54.

FIGS. 5 and 6 illustrate the spacing of the various bows about their respective collars.

As shown in FIGS. 7, 8, and 9, the reticulated centralizing apparatus 60 according to the present invention has two pairs of collars 62, 72 and 64, 74 emplaced about a casing member 70. Four bows 65, 66, 67, and 68 are connected to and extend between the collars 62 and 72, with each bow passing over the collar 64 which is emplaced between the collars 62 and 72. Four bows 75, 76, 77, and 78 are connected to and extend between the collars 64 and 74, with each bow passing over the collar 72 which is emplaced between the collars 64 and 74.

As shown in FIGS. 8 and 9, the bows 65–68 and 75–78 are spaced apart around their respective collars and pairs of collars alternate around the apparatus, i.e. pairs 66, 67; 77, 75; 65, 68; 78, 76.

Starting force is the force required to start a centralizer into a hole or into the opening in a tubular such as the opening in casing. Restoring force is the force exerted by centralizer bows when the centralizer contacts the inside of a tubular, testpipe, or wellbore. Restoring force is dependent, inter alia, on the extent to which the bows have to be compressed upon insertion into the wellbore. A bow which is stressed beyond its elastic limit may not have an adequate restoring force.

The American Petroleum Institute's (API) has recommended testing procedure for casing centralizers as follows: The following suggested testing equipment is optional. Variations are possible without affecting test validity or the ultimate results. For example: a testing jig may be designed to apply force from below instead of at the top. Also, the starting force assembly may be set up to pull the centralizer from the bottom. Variations such as these are being used by some manufacturers and are entirely acceptable. In all tests, outside diameter of the inner casing A and the inside diameter of the outer pipe B should correspond to common casing-hole size combinations. When a hole size is not available as a standard pipe inside diameter, a machined inside diameter with a 250 RMS finish will be acceptable. The outer surface of casing A and the inner surface of pipe B should resemble in smoothness API casing delivered from the pipe mill. The contacting surfaces should not show any mechanical damage and should be lubricated with a petroleum base grease before running the test. NOTE: API Modified type grease is recommended as a standard grease for the test. Other greases are allowable. Both pipes A and B should be completely cylindrical and their axial measurements longer than the total length of the centralizer under investigation after it is completely flattened. The centralizer to be tested should be attached to the casing in a manner similar to the method recommended by the centralizer manufacturer. Load measurements may be taken on a suitable tension-compression test machine that can be read accurately to one percent.

Figure 11:
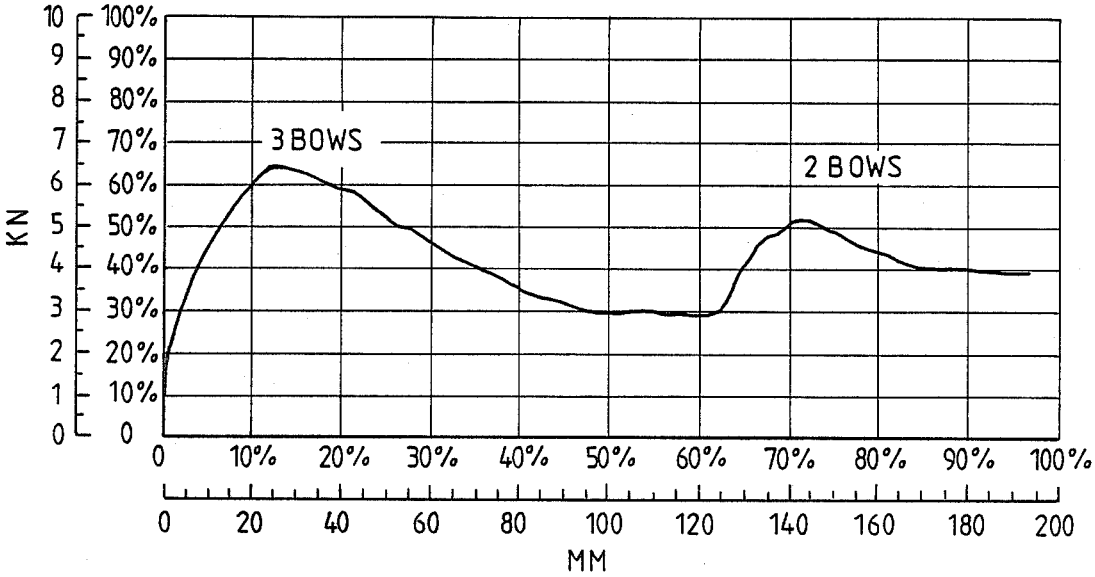
FIGS. 11 and 12 present graphs with data related to centralizing apparatuses according to this invention.
Figure 12:
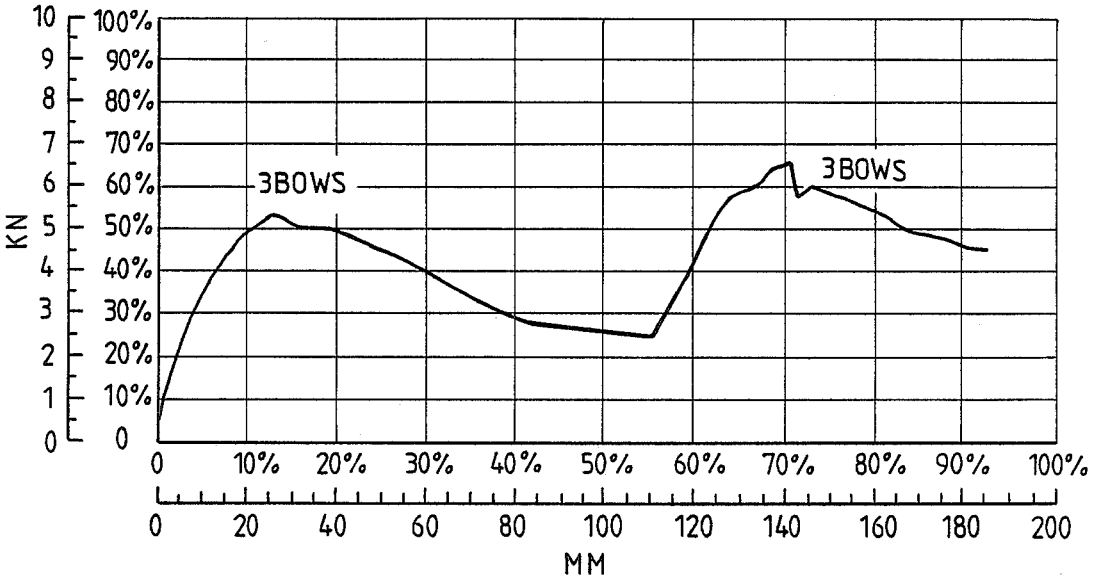

FIGS. 10–12 presents data regarding starting force for a prior art centralizer (FIG. 10) and reticulated centralizer apparatuses according to this invention (FIGS. 11, 12). The horizontal axes labelled "MM" show increasing movement in millimeters of a centralizer into a test pipe. The vertical axes have two labels. The "%" column indicates percentage of the maximum starting force indicated on the scale. The vertical column labelled "KN" indicates starting force in kilonewtons. The test method used was a conventional "over stop collar" method. The centralizer tested with results as shown in FIG. 10 was a prior art Weatherford ST-III-S centralizer (as described in "Product Information Cementing Aids GmbH" a copy of which is submitted herewith) with six bows spaced about and extending between two collars.

As shown in FIG. 10, the starting force for the prior art centralizer had a maximum of about 92 KN or about 92% of the scale maximum after about 28 millimeters of insertion into the test pipe.

By comparison to the prior art centralizer, centralizing apparatus according to the present invention were tested and the test results are presented in FIGS. 11 and 12. The test results in FIG. 11 relate to a centralizing apparatus as shown in FIG. 1 which was assembled using four collars, each identical to the collars used for the device represented by the data in FIG. 10 and using six bows, each identical to the bows of the device of FIG. 10. However, the collars and bows were disposed as shown in FIGS. 1–3. As shown in FIG. 11 the starting force was significantly reduced from about 92% to about 64% of the scale maximum (from about 9.2 KN to about 6.4 KN).

Again by comparison to the prior art centralizer of FIG. 10, a centralizing apparatus according to the present invention as shown in FIGS. 4–6 was tested using identical bows and collars to the device of FIG. 10. The results as shown in FIG. 11 indicate a starting force of about 66% of the scale maximum.

The charts shown in FIGS. 13–16 present various data for prior art centralizers and for centralizing apparatuses according to this invention. At the top of each chart is a horizontal graph which depicts the starting force in pounds force for each centralizer (the extent of the line in the middle of the graph marked with one asterisk, e.g. about 810 pounds force in FIG. 13) and the moving force (the point marked with two asterisks on the line, e.g. about 430 pounds force in FIG. 13).

For each chart 13–16 the generally horizontally extending lines in the large graphs indicate how close the centralizer or centralizing apparatus came to providing exact centering. A line coincident with the value 0.875 would indicate perfect centering—the opening into which the devices are inserted is 8.75 inches in diameter and the casing used is 7 inches in diameter; if all measurements from opening wall to outer wall were 0.875, then there would be perfect centering; therefore any measurement other than 0.875 indicates imperfect centering.

In each of the FIGS. 13–16 the API allowable minimum centering (or restoring) range is indicated by the small right angle symbol on the graph. The vertical axes of the large graphs indicate stand off or position of the casing with respect to the bore in inches; the horizontal axes labelled from "000" to "2400" indicates the force (in pounds force) exerted on the centralizer. To obtain the indicated graph lines a plurality of tests were run on each centralizer; e.g. each centralizer was rotated slightly several times and readings were taken at each position.

Figure 13:
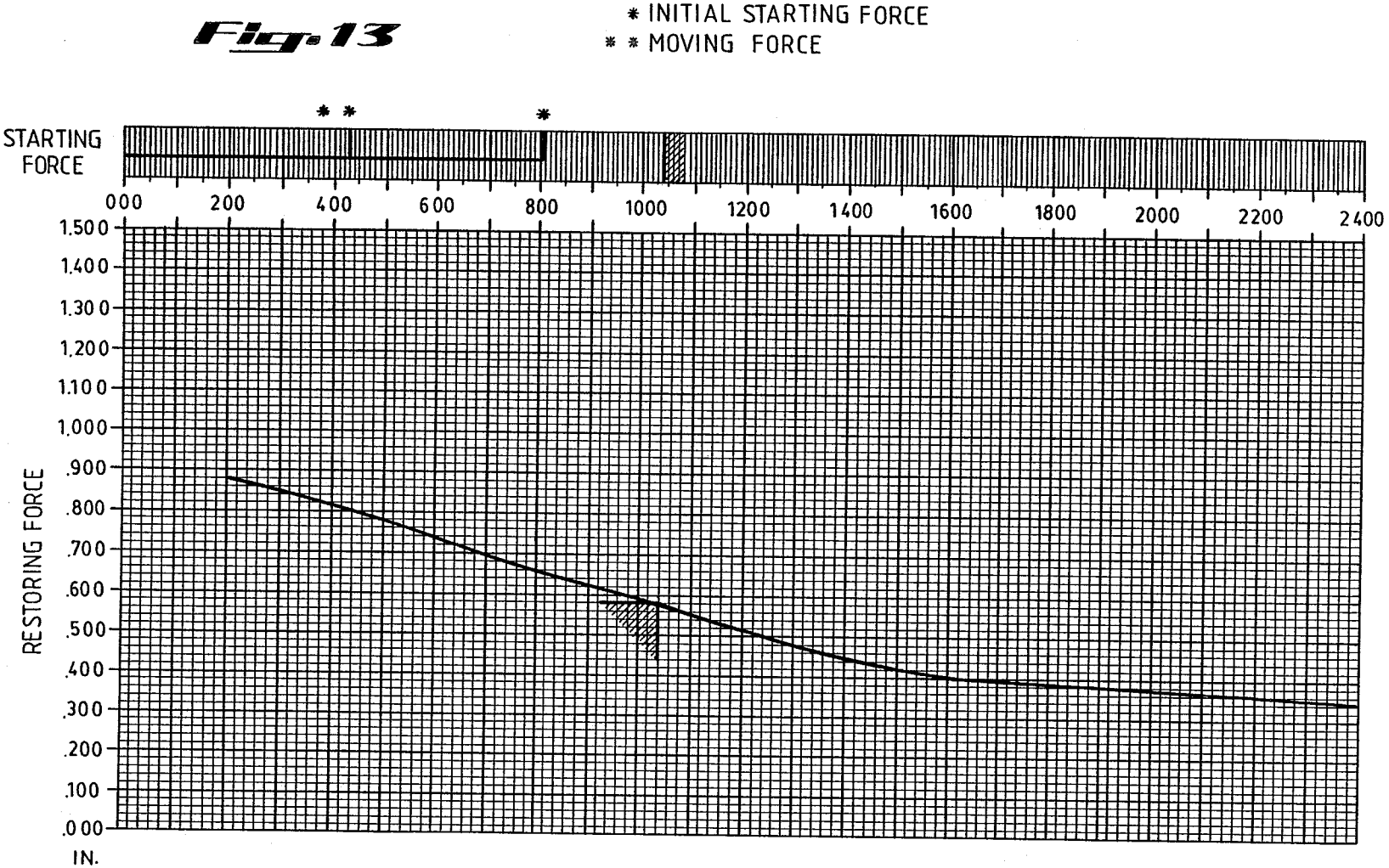
FIG. 13 presents a graph with data related to a prior art centralizer.

FIG. 13 illustrates the data for a prior art Weatherford seven inch centralizer (i.e. collars seven inches in inside diameter) with six bows of the ST2 bow type. The starting force was about 810 pounds force. As is readily apparent the centralizer provided centering barely acceptable by starting force but only a marginal restoring force.

Figure 14:
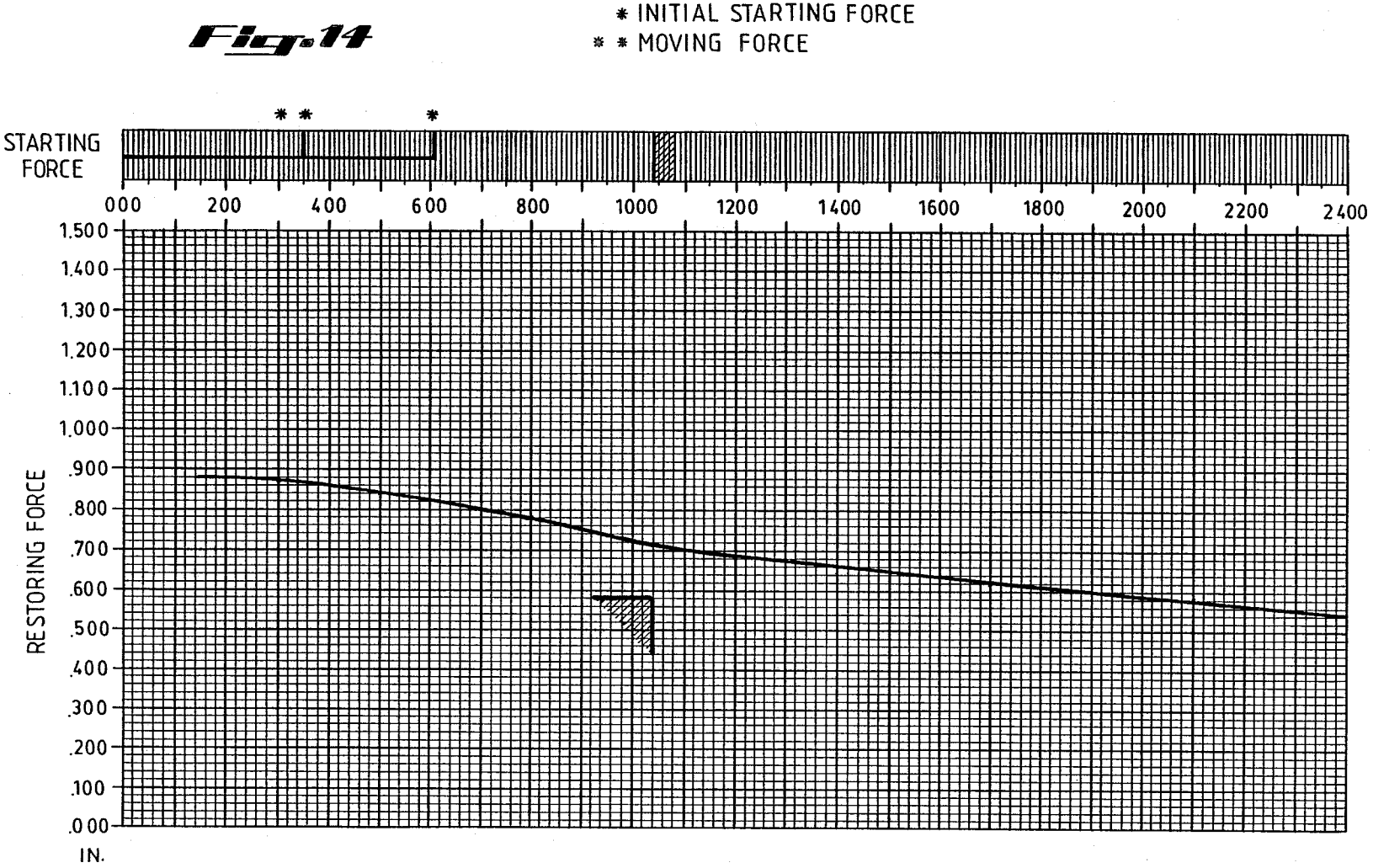
FIGS. 14–16 present graphs with data related to centralizing apparatuses according to this invention.

FIG. 14 illustrates the data for a centralizing apparatus according to the present invention as shown in FIGS. 1–3. Six bows of the ST2 type were used with four collars, each identical to the two collars of the device of FIG. 13. The starting force was about 600 pounds force. A comparison of the graphs of FIGS. 13 and 14 shows that the centralizing apparatus according to the present invention of FIG. 14 provided:

(a) centering effects above the API minimum range and (b) better centering than the prior art device of FIG. 13, although each device had the same number of bows.

Figure 15:
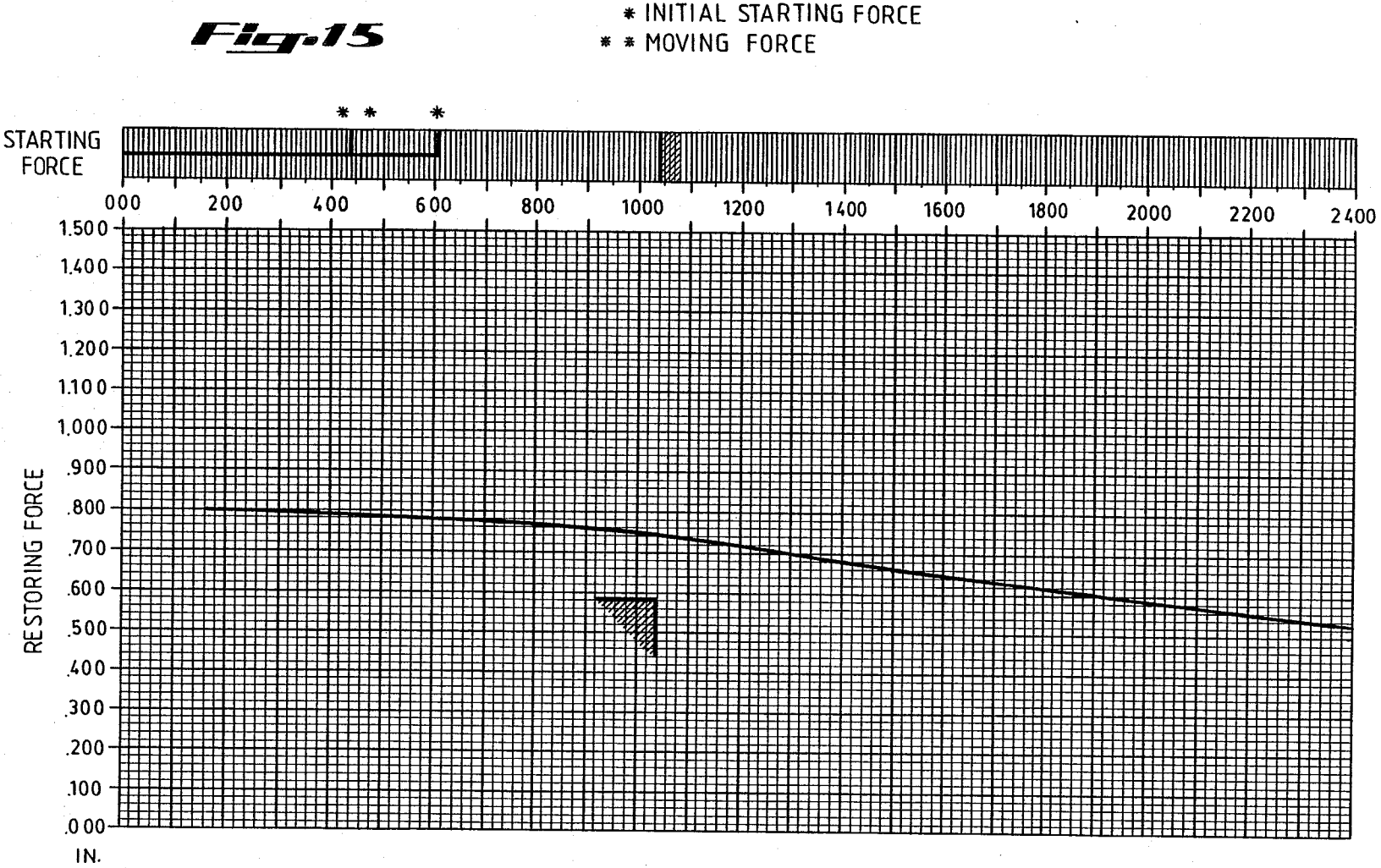

FIG. 15 presents data for a centralizing apparatus as shown in FIGS. 7–9 which utilized commercially available Weatherford non-weld collars and Weatherford ST2 bows. The starting force was about 610 pounds force and the moving force was about 430 pounds force. Again the graph indicates better centralizing effects than those obtained with the device of FIG. 13.

Figure 16:
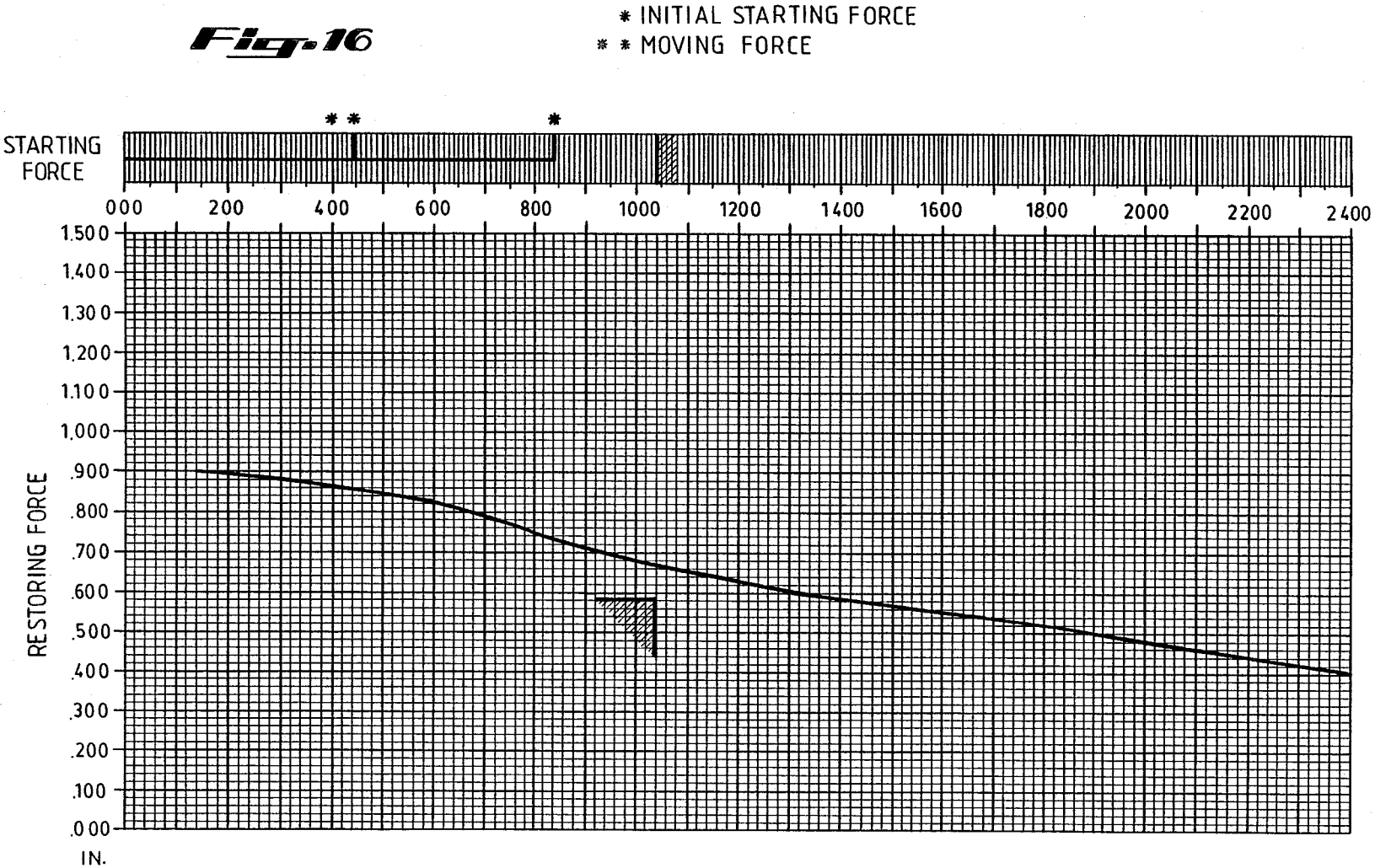

The device whose results are shown in FIG. 16 was of a type shown in FIG. 4, but the centralizing results are worse than those obtained for the devices of FIGS. 14 and 15 and only slightly better than those of the prior art device such as that of FIG. 13. This anomaly is attributed to at least one of the bows overriding a hinge on a collar. This is avoidable by carefully positioning the collars. Although some tests of centralizers with three collars and six bows produced results either comparable to or even very slightly better than a four-collar six-bow apparatus according to this invention, the apparatus according to this invention is much easier to handle and to assemble.

Although specific embodiments with specific numbers of bows and pairs of collars have been illustrated it is within the scope of this invention to use other numbers of pairs of collars and other numbers of bows. Also, although certain groupings of the bows have been shown in the drawings, this is not meant to preclude other grouping. For example with a particular tubular three, four, or more pairs of collars could be used and any desired number of bows disposed as desired between the various collar pairs.

A method according to this invention includes the steps of emplacing a first pair of collars about a casing joint in spaced-apart relation and securing the collars about the joint. Then the selected number of a first set of bows (each with an outwardly convex mid portion) are disposed between the pair of collars and one end of each bow is secured to each collar of the pair of collars. A second pair of collars are then emplaced about the casing joint in spaced-apart relation, with one of the collars of the second pair disposed between the collars of the first pair of collars. The selected number of a second set of bows are then disposed between the second pair of collars with one end of each bow secured to each collar and with the second set of bows staggered with respect to the first set of bows so that either the bows alternate singly—each bow of the first set is adjacent immediately to only bows of the second set—or groups of bows of one set alternate with either single bows or groups of bows of the other set. One end of the bows of one set will pass over one of the collars of the collar pair connected to the other set of bows.

In another method according to this invention part or all of a reticulated centralizing apparatus is pre-assembled and is then emplaced about a casing joint by inserting the joint into and through the collars.

Thus, it is seen that the apparatuses and methods of the present invention readily achieve the ends and advantages mentioned as well as other inherent therein. While certain preferred embodiments of the present invention have been described and illustrated for the purposes of disclosure, it will be clear to one of skill in this art who has the benefits of this invention's teachings that changes in the arrangement and construction of parts and steps may be made which changes are embodied within the spirit and scope of the present invention as claimed below. It is intended that each element or step recited in any of the following claims and each combination of elements is to be understood as referring to all equivalent elements or equivalent combinations for accomplishing substantially the same results in substantially the same or equivalent manner.

What is claimed is:

1. A reticulated centralizing apparatus for a tubular to assist in centering the tubular in an annular space in a bore into which the tubular is inserted, the centralizing apparatus comprising two or more pairs of spaced apart and aligned collars adapted to encircle the tubular, a plurality of spring bows extending between and secured to the collars, each bow having two ends and an outwardly convex mid-portion, each pair of collars having emplaced therebetween only one collar of one of the other pair or pairs of collars.

2. The appartus of claim 1 wherein there is an equal number of bows extending between each pair of collars.

3. The apparatus of claim 1 wherein the bows are staggered so that a portion of a bow extending between the collars of one pair of collars is disposed between each pair of bows extending between the collars of another pair of collars.

4. The apparatus of claim 1 wherein groups of adjacent bows are staggered so that for each group of bows extending between the collars of a particular pair of collars there is disposed therebetween a portion of a bow or group of bows extending between the collars of another pair of collars.

5. The apparatus of claim 4 wherein the bows extending between each pair of collars are grouped in twos.

6. The apparatus of claim 3 wherein there is a first pair of collars and a second pair of collars and three bows extend between each pair of collars.

7. The apparatus of claim 3 wherein there is a first pair of collars and a second pair of collars and two bows extend between the first pair of collars and four bows extend between the second pair of collars.

8. The apparatus of claim 1 wherein the tubular is a joint of well casing and the bore is a wellbore.

9. The apparatus of claim 1 wherein each of the plurality of bows is substantially the same.

10. A reticulated centralizing apparatus for a casing joint to assist in centering the joint in an annular space in a bore into which the joint is inserted, the centralizing apparatus comprising two or more pairs of spaced apart and aligned collars adapted to encircle the joint, a plurality of spring bows extending between and secured to the collars, each bow having two ends and an outwardly convex mid-portion, each pair of collars having emplaced therebetween only one collar of one of the other pair or pairs of collars and, the bows staggered so that a portion of a bow extending between the collars of one pair of collars is disposed between each pair of bows extending between the collars of another pair of collars.

11. A reticulated centralizing apparatus for a casing joint to assist in centering the joint in an annular space in a bore into which the joint is inserted, the centralizing apparatus comprising two or more pairs of spaced apart and aligned collars adapted to encircle the joint, a plurality of spring bows extending between and secured to the collars, each bow having two ends and an outwardly convex mid-portion, each pair of collars having emplaced therebetween only one collar of one of the other pair or pairs of collars, and wherein groups of adjacent bows are staggered so that for each group of bows extending between the collars of a particular pair of collars there is disposed therebetween a portion of a bow or group of bows extending between the collars of another pair of collars.

* * * * *